US005555679A

United States Patent [19]

Scherba

[11] Patent Number: 5,555,679

[45] Date of Patent: Sep. 17, 1996

[54] INFLATABLE DEVICE

[76] Inventor: Robert Scherba, 3671 Medina Line Rd., Richfield, Ohio 44286

[21] Appl. No.: 328,132

[22] Filed: Oct. 24, 1994

[51] Int. Cl.[6] ..... E04B 1/34

[52] U.S. Cl. ..... 52/2.18; 52/2.17; 52/2.22; 52/2.24; 52/63; 135/126; 135/128

[58] Field of Search ..... 52/2.18, 2.17, 52/2.16, 2.13, 2.11, 2.22, 2.24, 795, 63; 472/134, 136; 135/97, 20.2, 128, 119, 117, 115, 126; 5/99.1, 414, 471

[56] References Cited

U.S. PATENT DOCUMENTS

| | | | |
|---|---|---|---|
| 2,168,913 | 8/1939 | Middleton | 135/119 X |
| 2,221,366 | 11/1940 | Bisbing et al. | 135/117 X |
| 2,836,860 | 6/1958 | Staropoci | 52/63 X |
| 3,744,195 | 7/1973 | Ferkick | 52/63 |
| 4,296,960 | 10/1981 | Winchester | 52/2.18 X |
| 4,959,901 | 10/1990 | Parish | 52/2.18 |
| 5,007,212 | 4/1991 | Fritts et al. | 52/2.18 |
| 5,205,086 | 4/1993 | Heim | 52/2.18 X |
| 5,341,530 | 8/1994 | Ward | 5/414 X |

FOREIGN PATENT DOCUMENTS

| | | | |
|---|---|---|---|
| 1074765 | 10/1954 | France | 52/2.18 |

*Primary Examiner*—Robert J. Canfield
*Attorney, Agent, or Firm*—Joseph H. Taddeo

[57] ABSTRACT

An inflatable device for use as a bar, carnival stand, exposition stall or the like. The bar is comprised of bar segments, canopy and roof tubes for canopy supports, the segments and tubes having fluid communication therebetween, and the tubes in fluid communication with one another. A durable counter rests upon interior walls positioned transversely in the segments to form a countertop of the bar. The device is inflated by an electric fan or blower.

15 Claims, 12 Drawing Sheets

INFLATABLE DEVICE

FIELD OF THE INVENTION

This invention pertains to an inflatable device for advertising applications or the like. More particularly, the inflatable device is designed and otherwise adapted for use as a bar, carnival stand, convention or exposition stall adapted for easy installation, take down and portability.

BACKGROUND OF THE INVENTION

Large inflatable, tethered balloons which are shaped like animals, dinosaurs and cartoon characters have been used in the past for advertising purposes. Such inflatable images are generally very large to provide maximum visibility for installation on a roof top, lawn space or in a parking lot, while tethered to the ground or other surface.

The inflatables can be suspended by a gas (generally air) communicating therethrough. The device is typically inflated by means of a continuously running electric fan. As the fan provides pressurized gas, the inflatable assumes a designated shape, such as a dinosaur, gorilla, elephant or cartoon character.

U.S. Pat. No. 5,125,177, to Colting, overcomes the disadvantage of many inflatables, that their immutable shape is designated for only a single purpose whereby a different inflatable is required for each application. Colting provides a cylindrical base with a means for attachment of various inflatable characters.

Many similar balloon devices are lighter than air to float in the sky while anchored from below. U.S. Pat. No. 4,125,233, to Winker, et al., for example, discloses a tethered aerodynamic balloon with integral fins.

Analogous balloons have also been sculpted or otherwise adapted for use as toys. See, U.S. Pat. No. 4,077,588, to Hurst; U.S. Pat. No. 4,758,198, to Ishiwa; U.S. Pat. No. 4,895,546 to Rakonjac; and U.S. Pat. No. 5,186,675 to D. Stoddard.

However, none of the foregoing has any practical utility other than for airborne advertising or for use as a toy.

Accordingly, it is a primary object of the present invention to provide an inflatable device designed for practical use to serve as a bar having a canopy suspended above it. Alternatively, but in a similar manner, the inflatable device can function as a self-enclosed carnival or festival stand. Further, the inflatable device can have utility as a convention or exposition stall.

Similar bars, stands or stalls are usually constructed of wood, or thick, inflexible plastic or glass panels adapted for connection by standard hinges or fasteners when assembled at a designated site. Such panels are generally sturdy and heavy enough to require transportation by truck and their installation is generally done by movers, maintenance or construction workers.

Another object of the invention is to provide a bar which is lightweight and easily portable to facilitate set up by simply inflating the device and tear down by deflation.

The bar can also be used as an advertising and promotional device by incorporation of product marks or emblems, corporate logos or other indicia into the elastomeric material comprising the bar or by attachment of advertising posters, designs and literature in pouches for attachment to the bar.

SUMMARY OF THE INVENTION

These and other objects of the invention are achieved by an inflatable device comprising an inflatable bar which includes a canopy removably suspended in position above the bar. A suspension means is provided for the purpose of retaining the canopy in position.

The device also incorporates an inflating means having fluid communication with the bar and suspension means for delivery of a fluid to inflate the device.

The bar is preferably comprised of four bar segments, each bar segment interconnected by a roof tube. The tubes are attached together at their outer ends, thereby enabling fluid communication between the bar segments and roof tubes, and between the roof tubes themselves.

BRIEF DESCRIPTION OF THE SEVERAL VIEWS OF THE DRAWING

The present invention will be best understood when reference is had to the accompanying drawings, wherein identical part numbers are used to refer to identical parts and wherein.

DETAILED DESCRIPTION OF THE DRAWINGS

Figure 1:
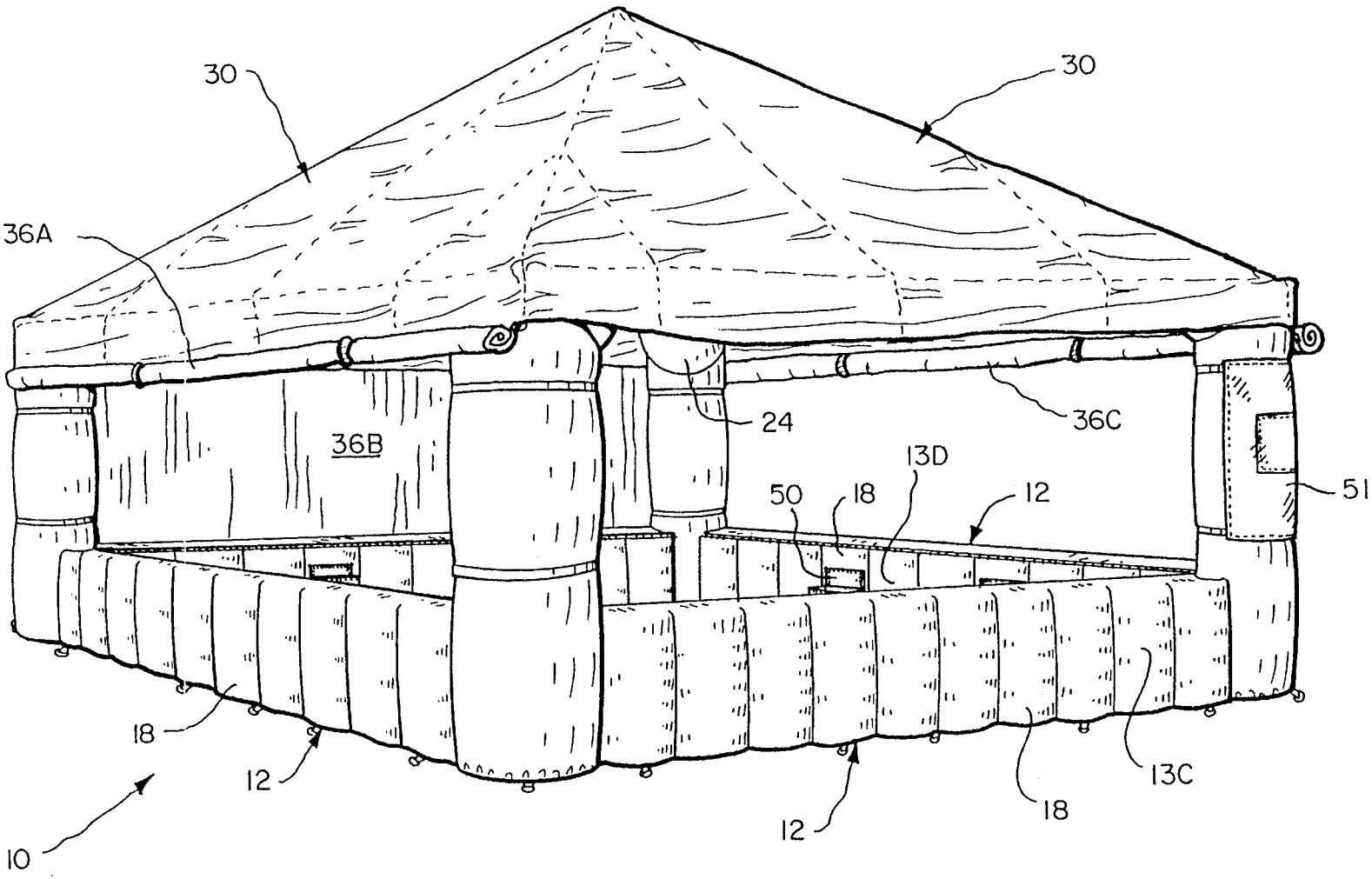
FIG. 1 is perspective view of the inflatable device of the subject invention.

The inflatable device 10 according to the present invention and primary components thereof are shown in the various views of FIGS. 1–11, to which attention is now directed. The inflatable device comprises five primary pieces when in disassembled condition: a counter cell 12, an air intake port 14 (FIG.12), an air blower 16 (FIG.6), a counter segment 18, a roof tube 24, a top canopy 30, and side curtains 36A–D.

Figure 7:
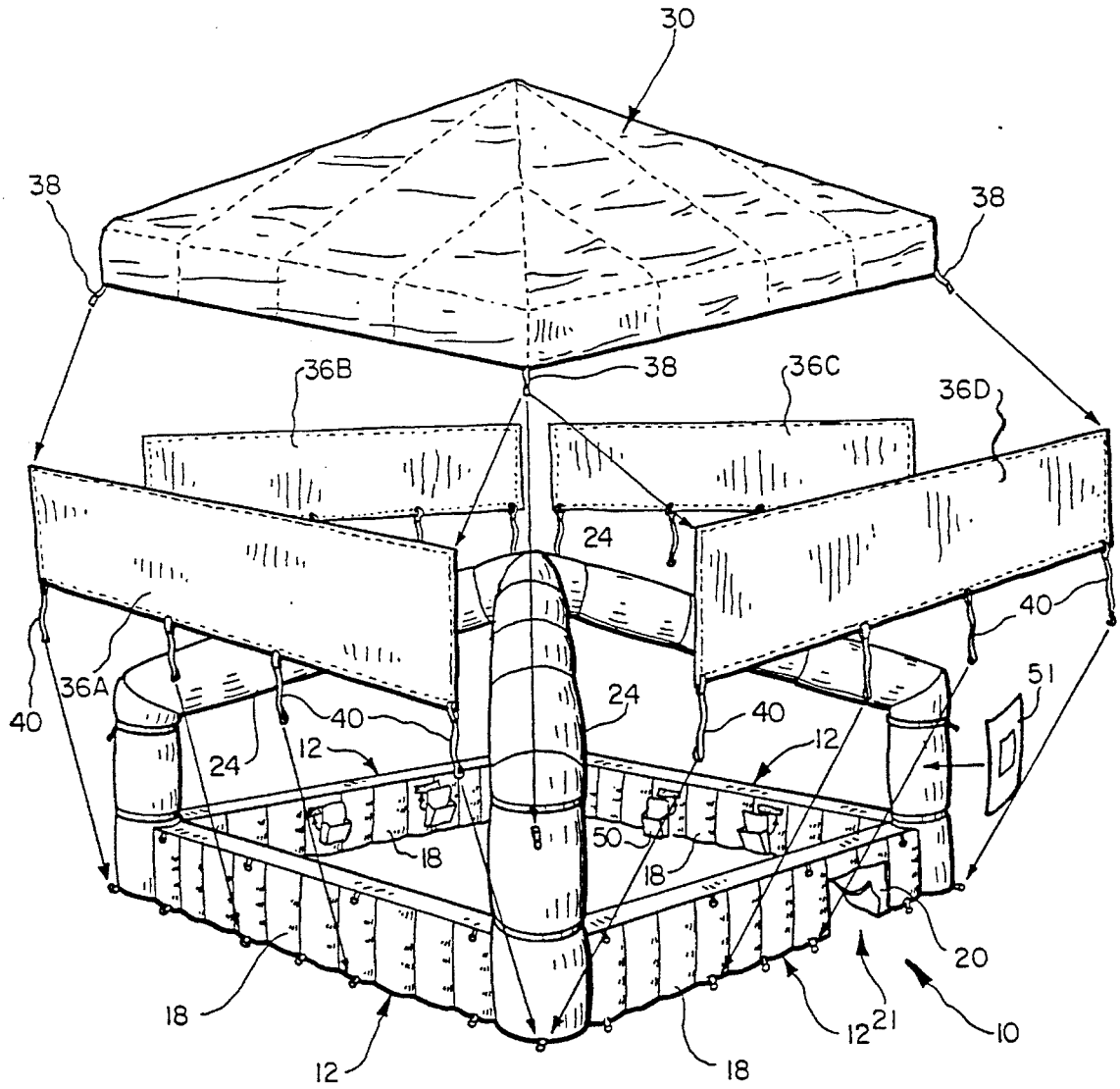
FIG. 7 is a plan perspective of the inflatable device of the subject invention.

Referring now to FIG. 7, a plan perspective, the drawing indicates the interrelation of the fundamental device components. When it is formed to resemble a bar, the device preferably has four sides. But when constructed for use as a bar, the device could have only a single side with one, two or more roof tubes 24 for support stanchions and suitable tethers for anchoring and for further support. However, the formation with four sides as shown in FIGS. 1–7, has been found preferable to serve as a self-enclosed bar, festival stand or stall for an exhibition, state fair, political campaign or like gathering.

Figure 12:
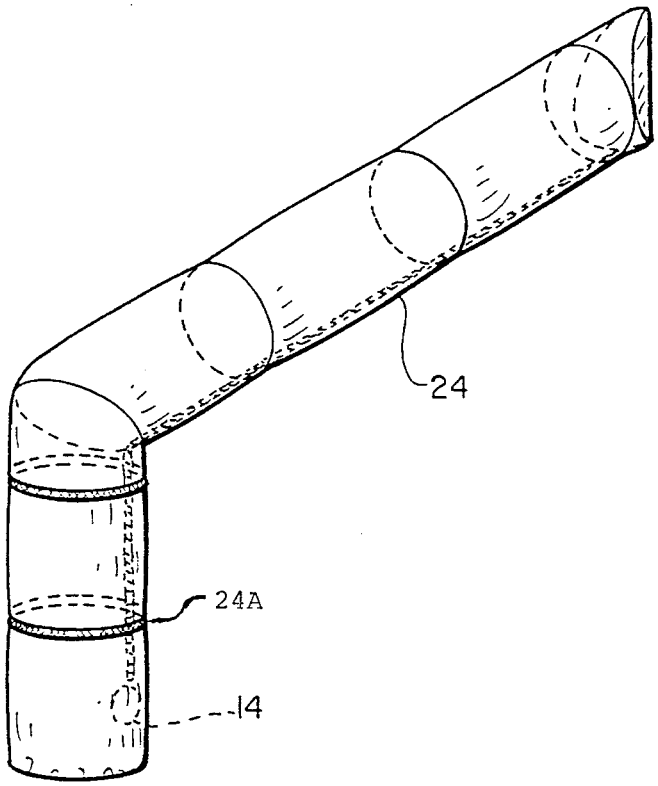
FIG. 12 is a side plan of a roof tube for the inflatable device.

The positioning for intake port 14, in a support tube 24 as shown in FIG. 12, is preferable for being remote to central activities within the area of the four enclosed sides or segments 18. Alternatively, the intake port 14 could be positioned in a cell 12 of the bar segment 18. (See FIGS. 8–9).

Air blower 16 is adapted to provide air pressure for inflating the device 10 and for maintenance of such pressure in the inflated device in a range between eight to twenty-seven psi. More preferably, the device is inflated by cool air to a range between fourteen to twenty-one psi.

Figure 2:
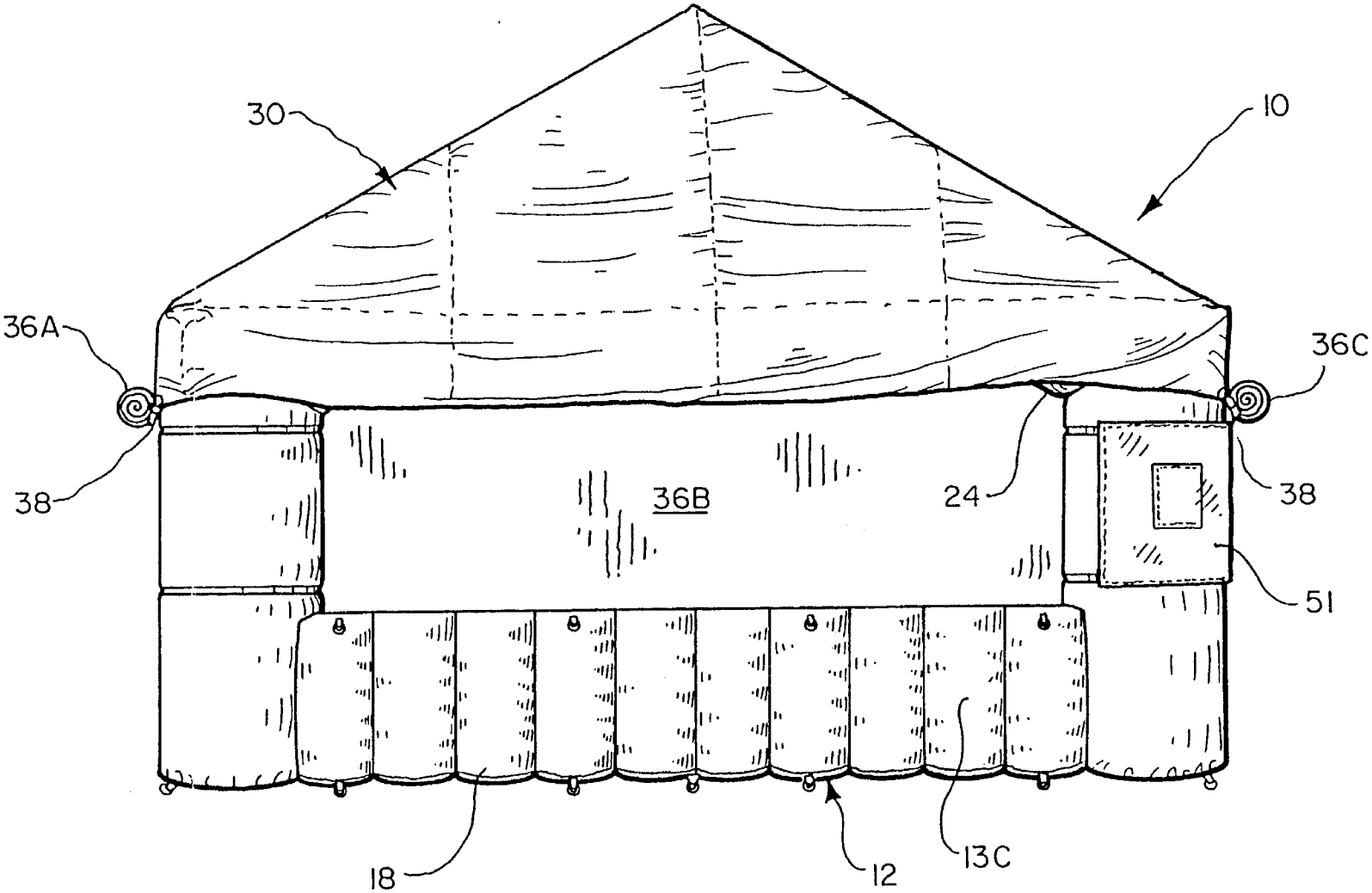
FIG. 2 is a front elevation of the inflatable device.
Figure 3:
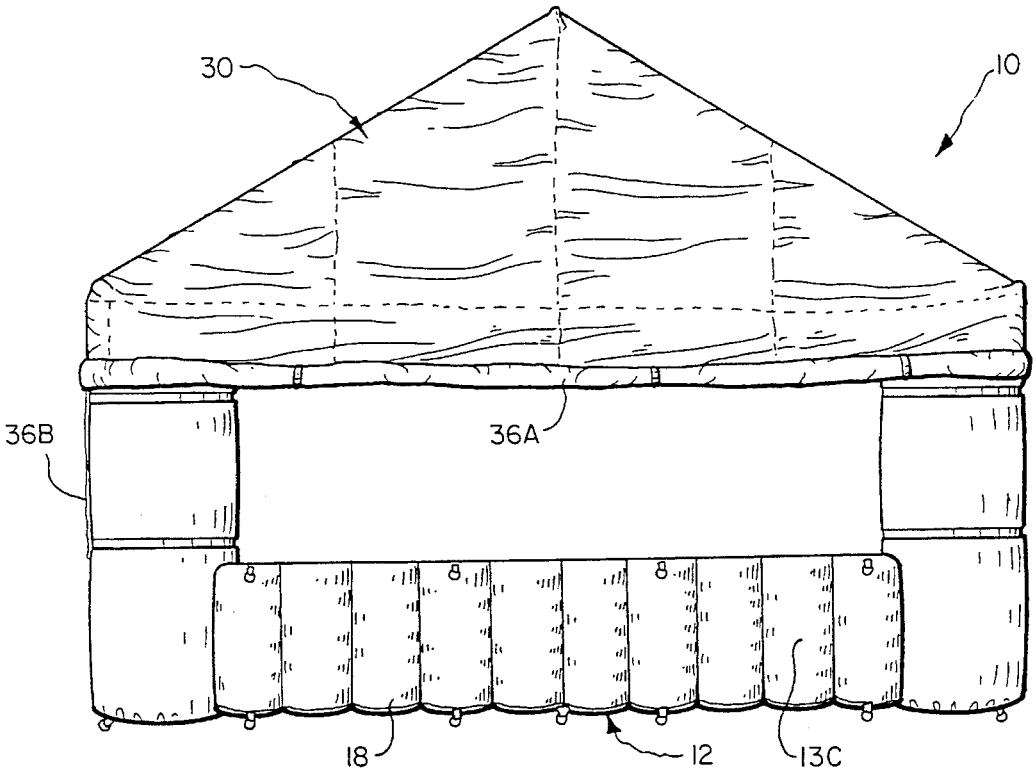
FIG. 3 is a side elevation of the inflatable device, the two sides of the device being substantially identical.
Figure 4:
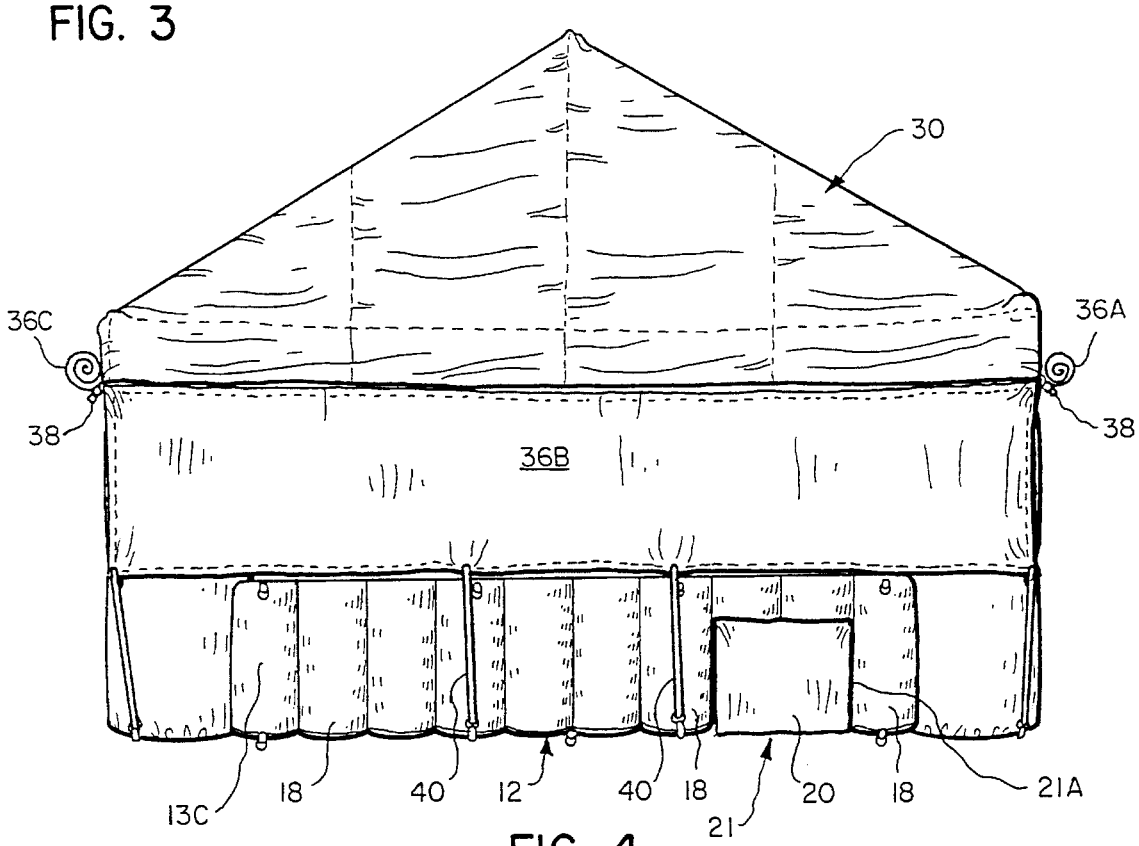
FIG. 4 is a rear perspective view of the inflatable device, with the lower curtain in closed position.
Figure 5:
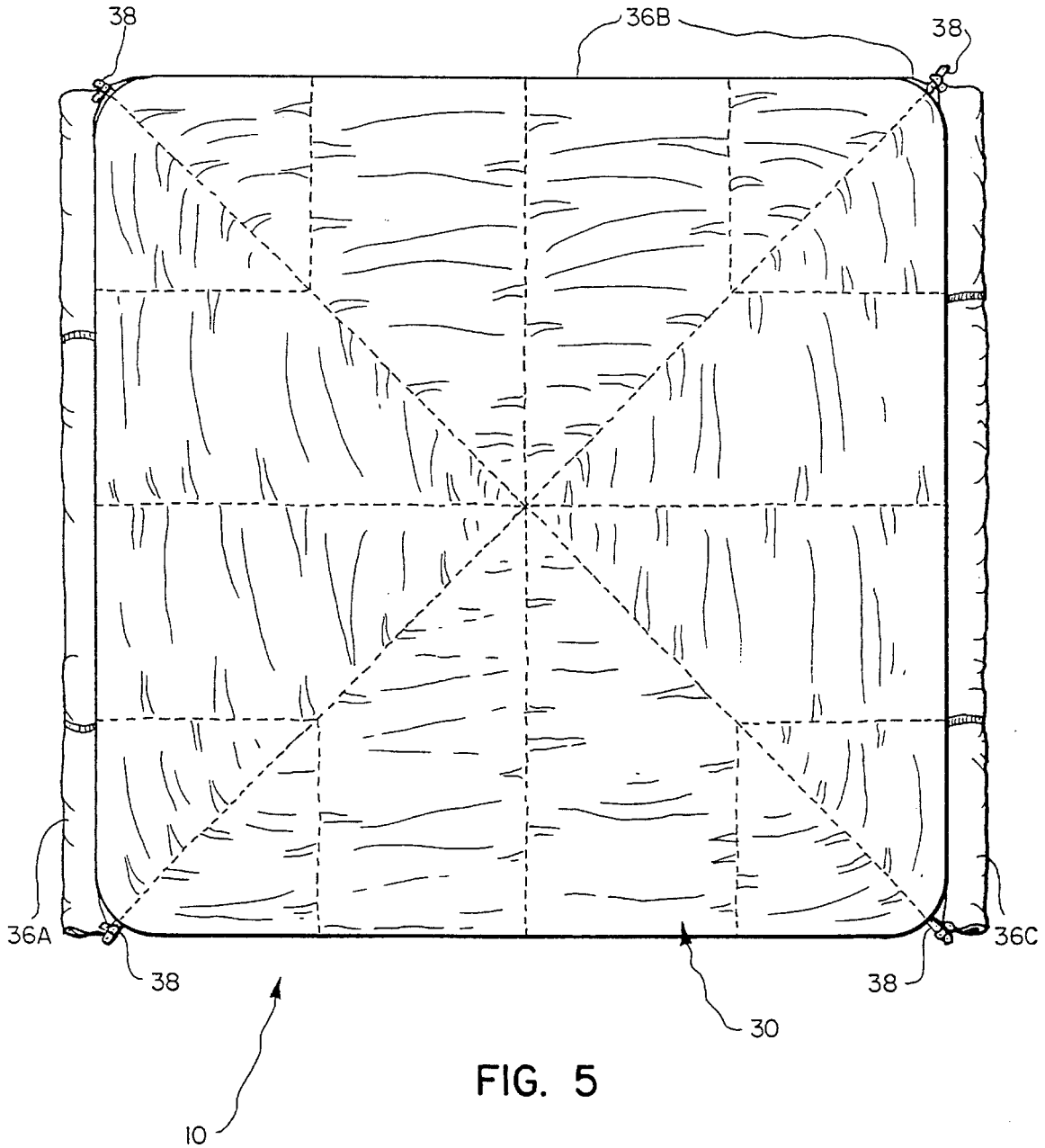
FIG. 5 is a top elevation of the top canopy for the inflatable device.
Figure 6:
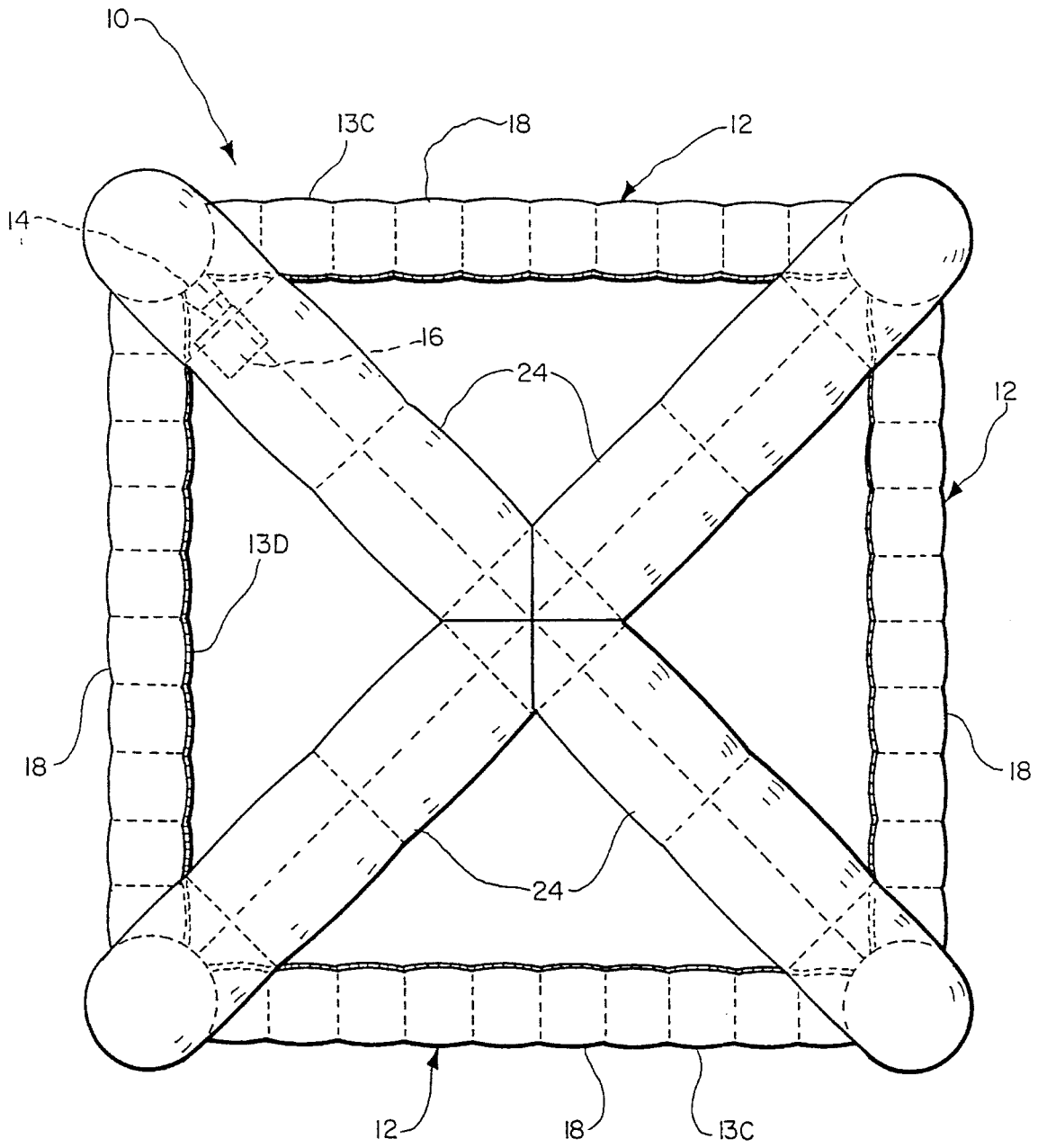
FIG. 6 is a top plan view of the inflatable device with the top canopy removed.

The inflatable device formed as an inflatable bar is further disclosed in FIG. 2, which is a front elevation thereof. The two sides of the device, FIG. 3, are substantially identical. Referring to FIG. 4, a back elevation of the inflatable device, panel 20 forms an access door 21 within the back counter segment 18 for entry and exit from the bar 10. The panel 20 forms an essentially airtight connection with, and is secured to, segment 18 by a zipper or VELCRO™ seal 21A.

Figure 8:
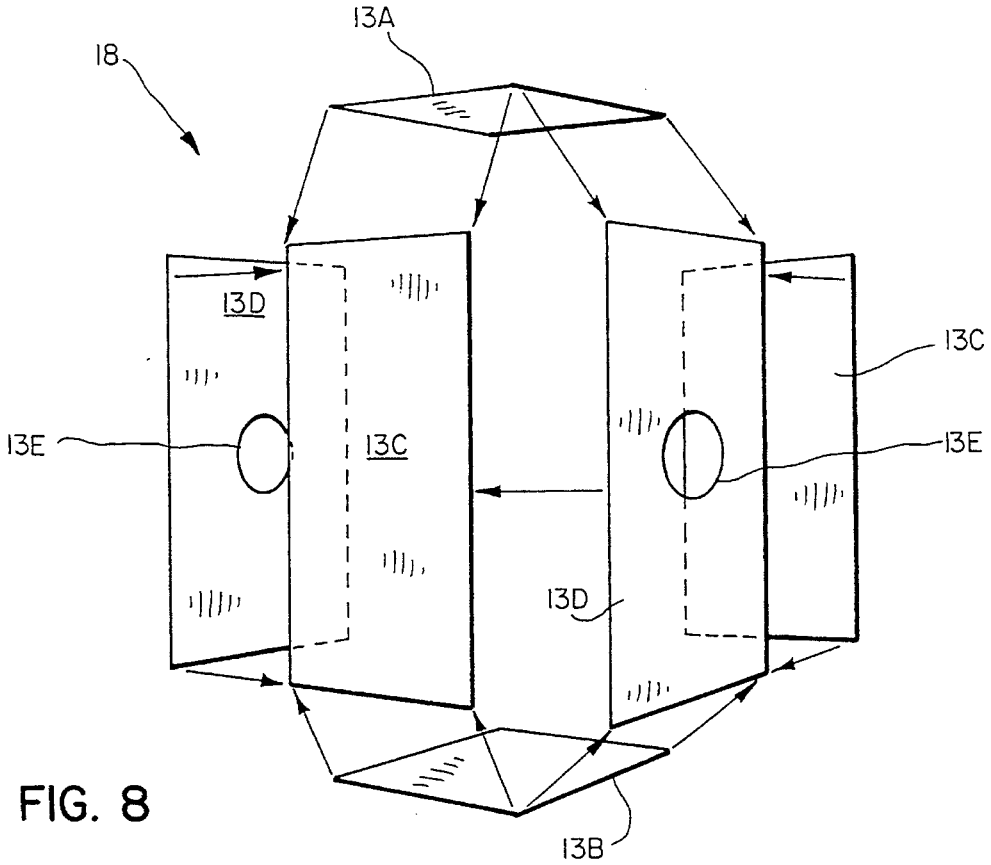
FIG. 8 is a plan view of a counter cell.
Figure 9:
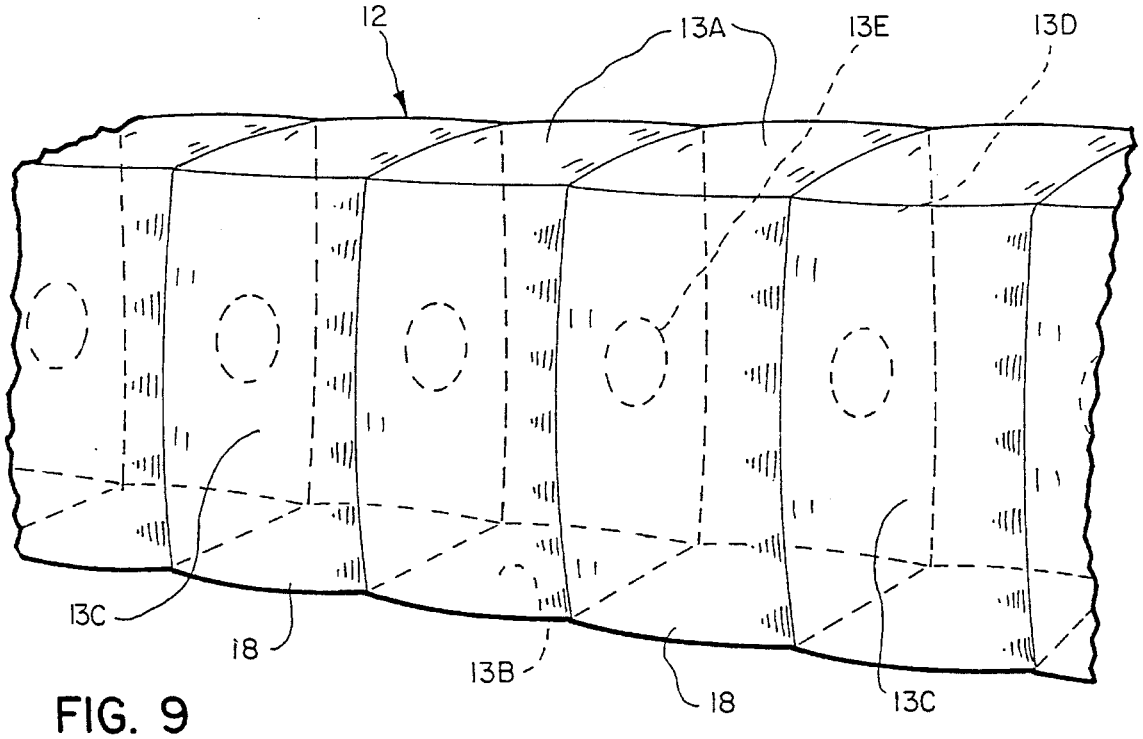
FIG. 9 is a plan view of the internal walls of a counter cell.

Referring now to FIGS. 8 and 9, it will be understood that each counter segment 18 is formed by a series of interconnected counter cells 12, each having a top 13A, bottom 13B and side walls 13C as well as internal walls 13D with a small hole 13E therethrough for fluid communication between the cells. The internal walls 13D of a cell 12 provide stability to the counter segments and allow tops of segments 18 to be horizontally level. At the same time, air delivered by blower 16 traverses throughout the device.

Top canopy 30, shown by FIGS. 1–5 and 7, is formed either as an enclosed airtight plenum assembly in fluid communication with support tubes 24, or as a single material piece, and is suspended in position above the bar by support tubes or roof tubes 24. A lower end of each tube 24 is interconnected and in fluid communication with counter segments 18. Meanwhile, the upper tube ends are also interconnected to form a roof tube assembly, with fluid communication between the segments 18 and each support tube 4 of the assembly.

Each roof tube 24 preferably includes several stays or rings 4A, which may be installed inside or on the outer surface of a roof tube, for maintaining the columnar shape of each roof tube; and, material forming the tubes may be sealed by zipper or VELCRO™ connectors. A single, horseshoe shaped roof tube could suffice for a one-sided bar; or, a bar with one segment. Stability for the device is enhanced and complete enclosure achieved by an inflatable device having four sides as indicated by FIGS. 1–7.

The roof tubes 24 project upward, away from and essentially orthogonal to the plane of the interconnected counter segments 18 to form an upstanding column portion, then the tubes further extend, at an angle from the column portion to form a buttress portion of the tube, to a point for interconnection of the tubes to surmount the bar. (See FIG. 12.)

Figure 13:
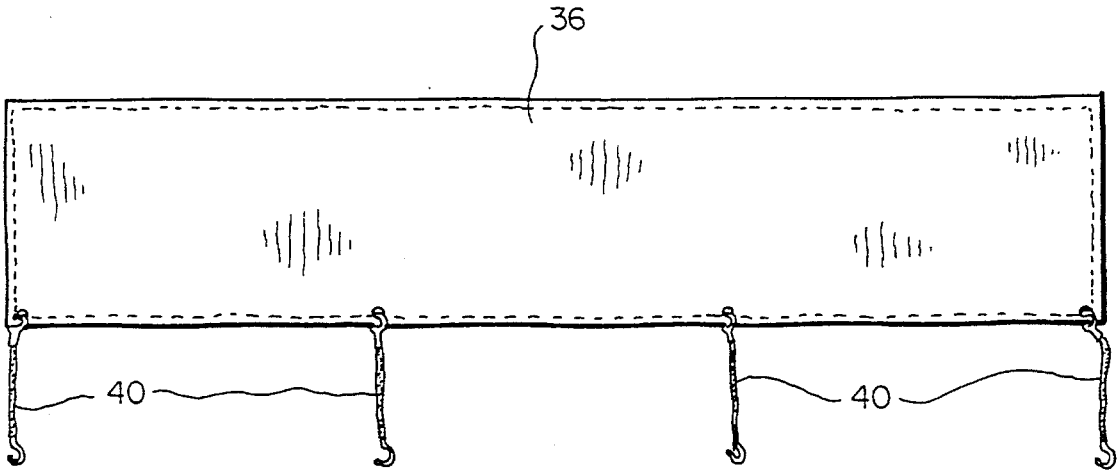
FIG. 13 is a front view of a side curtain.
Figure 14:
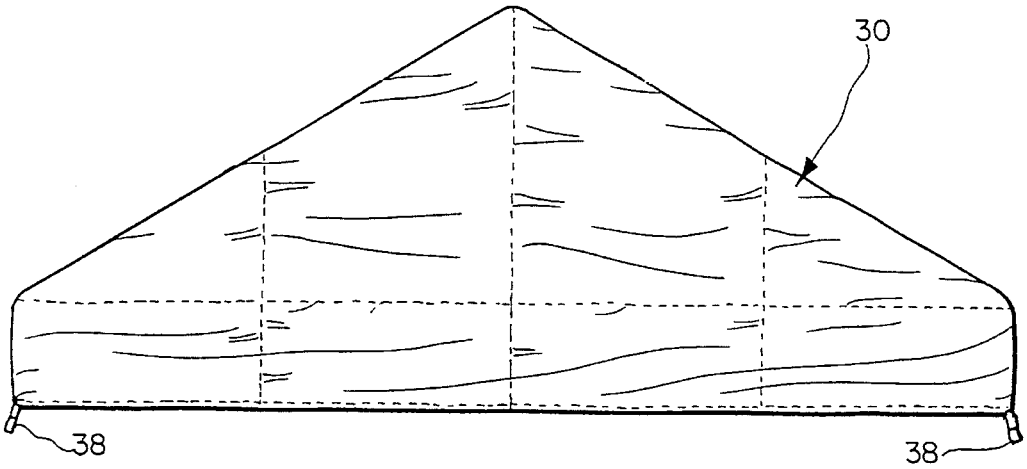
FIG. 14 is side elevation of the top canopy.
Figure 15:
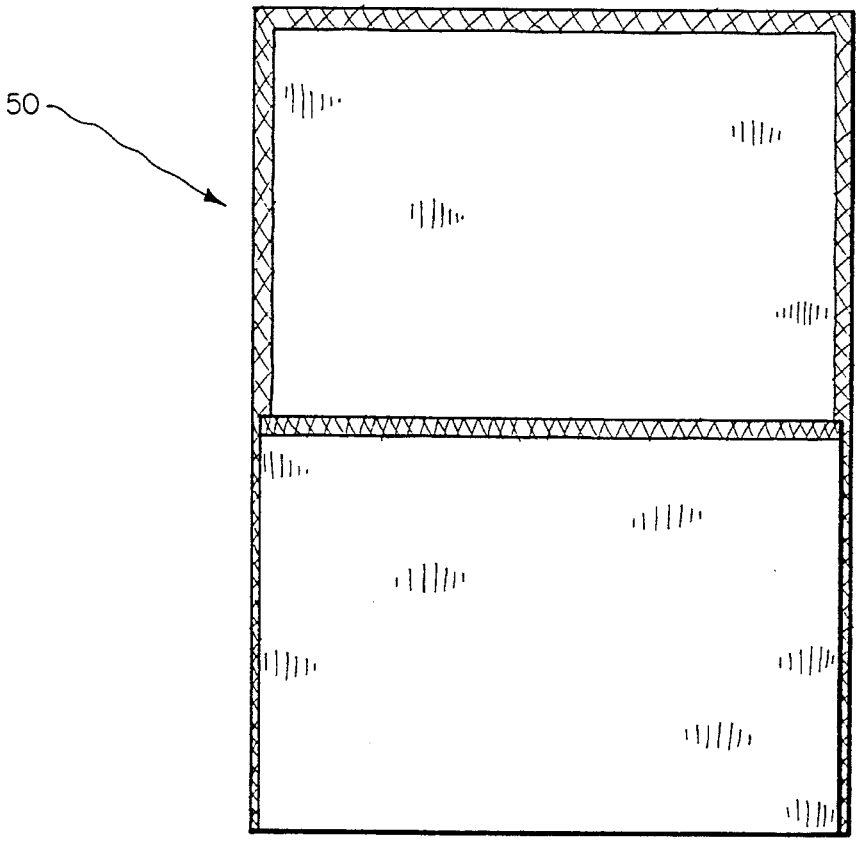
FIG. 15 is a front view of an information pouch.
Figure 16:
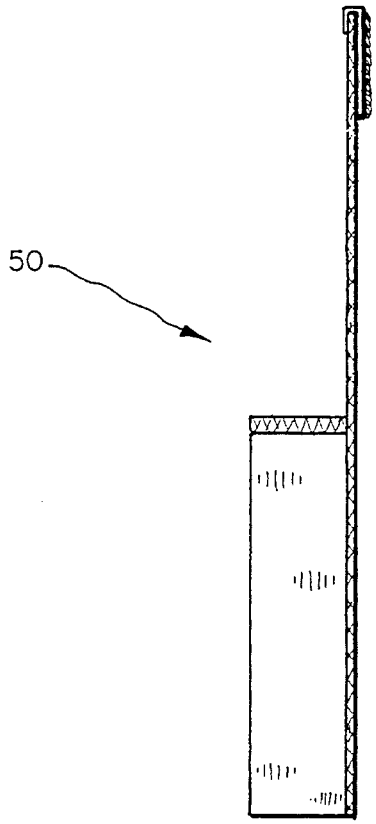
FIG. 16 is a side view of the information pouch shown in FIG.
Figure 17:
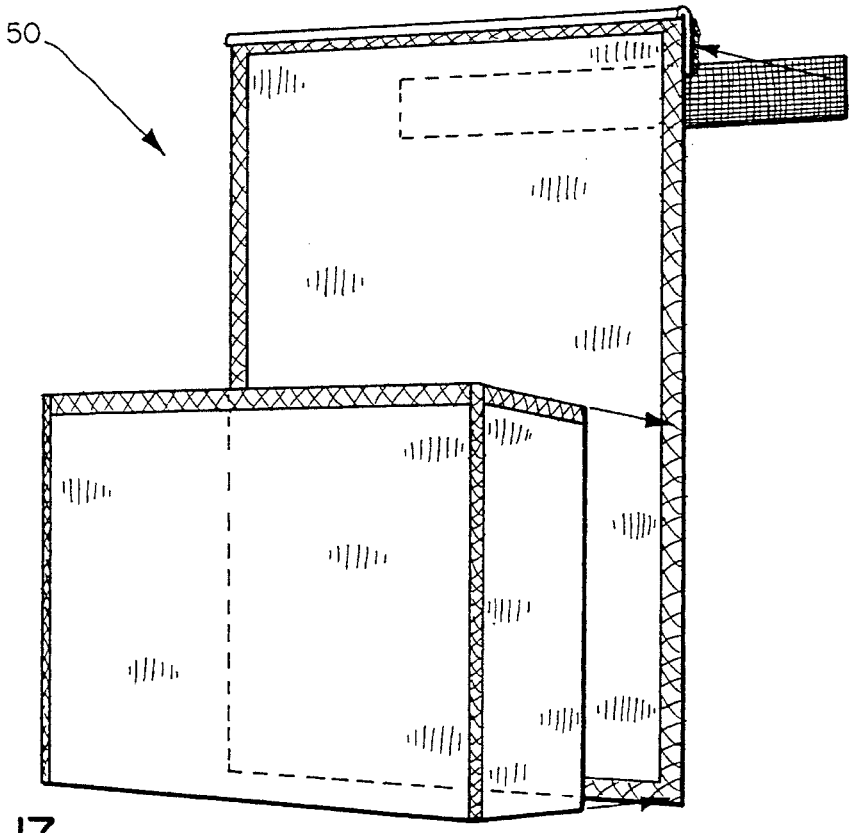
FIG. 17 is a front side elevation of the information pouch.
Figure 18:
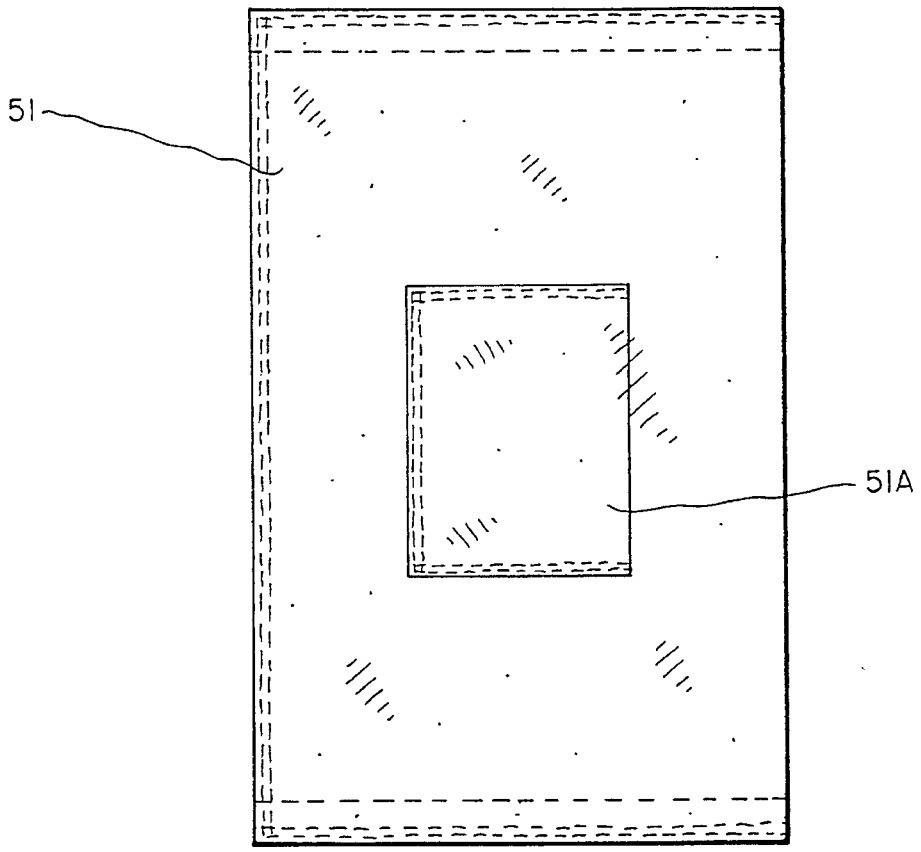
FIG. 18 is a front view of a poster display pouch for the inflatable device; and, FIG. 19 is plan view of the poster display pouch.
Figure 19:
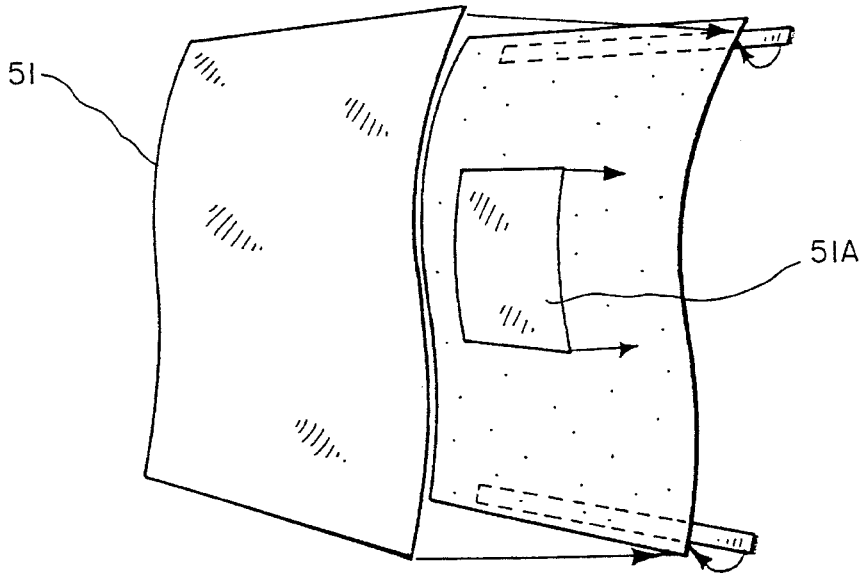

The top canopy 30 generally includes a side curtain 36 suspended from an edges of the canopy by suitable grommets 38 in the canopy and curtain edges, and the string or belt connectors 40 shown in FIG. 13. The top canopy 30 is removably attached to the tube assembly and the side curtain portions may be removably attached to the top canopy and further removably attached to one or more tubes 24 of the tubing assembly. Alternatively the top canopy and side curtain edges may be sewn together, or connected by zipper or VELCRO™ connectors.

Figure 10B:
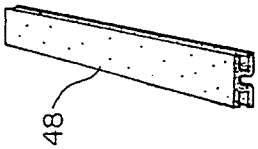
FIG. 10B is an elevation of a panel hinge showing the flat side thereof.
Figure 10A:
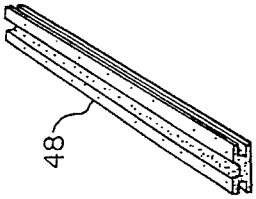
FIG. 10A is an elevation of a panel hinge showing the grooved side thereof.
Figure 10:
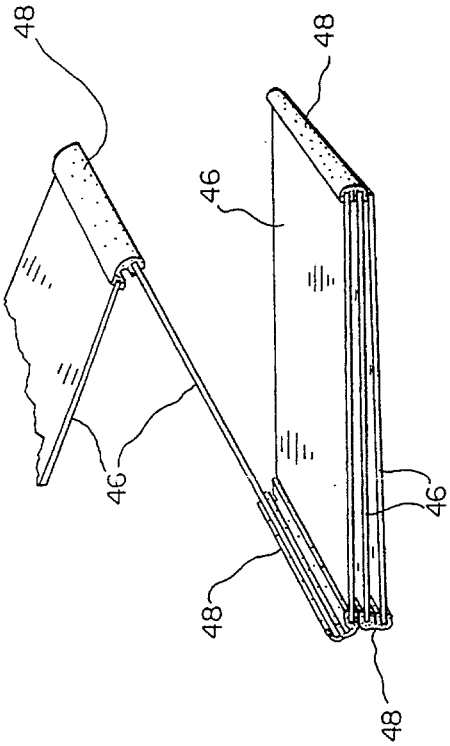
FIG. 10 is a plan view of the folding countertop for the inflatable device.
Figure 11:
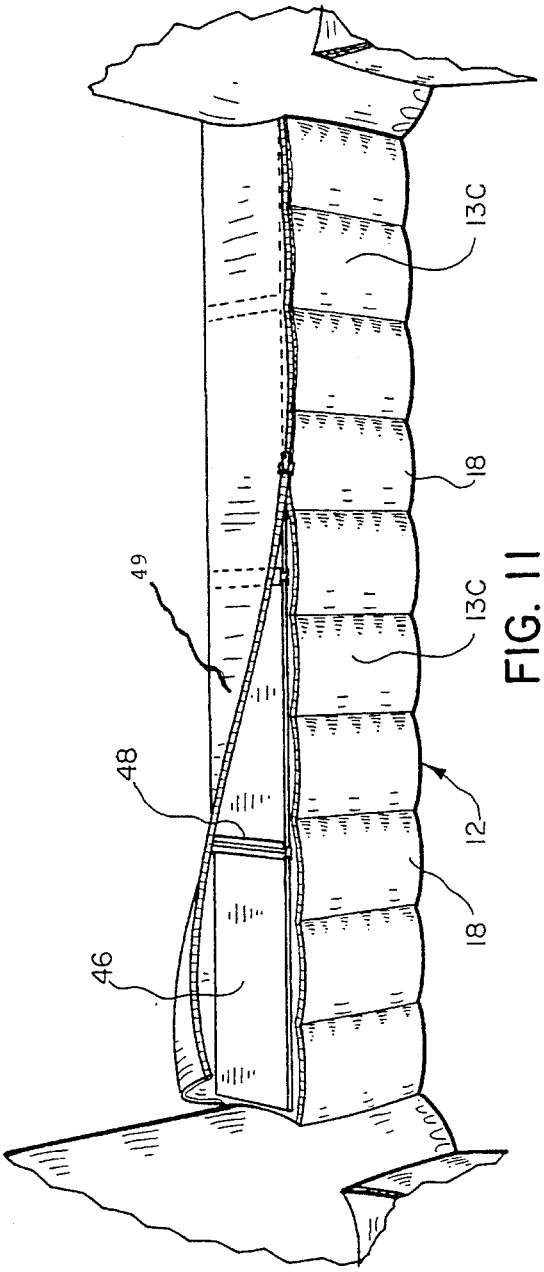
FIG. 11 is a plan view of a bar segment showing installation of a countertop.

Referring now to FIGS. 10–11, a flat countertop 46 is provided for the assembly and for facility in construction and storage. The countertop is formed by connecting several individual panels 46 together with plastic hinges 48. The countertop can be folded upon itself for storage.

Each of the hinges 48 has a center folding groove and a pair of side grooves; and, each of the side grooves is dimensioned to receive and frictionally retain a panel 46 within the groove. The hinges described are vinyl or other polymeric material and the countertop panels are preferably constructed of a hard material such as thick plastic, wood or metal. The external walls of counter segments 18, roof tubes 24, and canopy 30, can be preferably constructed by using a variety of plastic materials including polypropelene, polystyrene, polyethylene terephthalate (Mylar), coated nylons and other known resins for wrapping and sealing.

Constructed in this way, each of the counter or bar segments is formed as an elongate, airtight tube which has a generally rectangular shape. A series of interior walls 13D traverse the tube to form the cells within the duct and a means for support of the countertop 46. The hole 13E through each of these interior walls forming a cell 12 allows for fluid communication between the cells. A layer of material 49 is provided for covering the countertop 46 of the bar segment. The covering material 49 edges may be sewn together, or connected by zipper or VELCRO™ connectors to material forming the bar segment.

An access door 21, shown in FIGS. 4 and 7, at the back of the bar or stall is sealed to the back segment wall by a zipper or VELCRO™ seal to provide a means for removably securing the access door to the inside wall and complementary portion of opposed outside wall of the back bar or counter segment 18 enabling entry and exit from behind the bar.

Reference to FIGS. 15–19 indicates that the inflatable device further includes one or more reclosable pouches 50 which are removably secured upon the inside wall of a bar segment. And poster display pouches 51 with clear front portions 51A can also be removably adhered to the column portions of the roof tubes 24 as shown. (See FIGS. 1,2,7,17 and 19.)

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular suggestion or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An inflatable device comprising:

an inflatable bar;

an inflating means having fluid communication with the bar for delivering a fluid to inflate the device;

a canopy demountably positioned above the bar;

a suspension means for retaining the canopy in position above the bar;

wherein the bar comprises four bar segments in a plane, and four roof tubes each having first and second ends, each segment essentially comprising a side of the bar, said sides interconnected by a roof tube near a tube first end, and said tubes interconnected at the second ends thereof to form a roof tube assembly, with fluid communication between said segments and said tubes of the assembly;

wherein each of said roof tubes projects upward, away from and essentially orthogonal to the plane of its interconnected bar segments to form an upstanding column portion, then further extending, angularly from the column to form a buttress portion of the tube, to a point of interconnection of the tubes above the bar;

wherein the canopy comprises a top portion and a side curtain portion;

said top canopy portion removably attached to the tube assembly;

said side curtain portion removably attached to the top canopy and further attached to one or more tubes of the tubing assembly; and, further comprising at least one counter, each said at least one counter comprising a flat surface forming a countertop of the bar; and, support means associated with each said at least one counter.

2. An inflatable device according to claim 1, wherein the canopy is a sheet formed of at least one material piece.

3. The inflatable device according to claim 1, wherein a countertop is comprised of a plurality of individual panels.

4. The inflatable device according to claim 3, further comprising at least one hinge, wherein the at least one hinge interconnects the plurality of panels whereby the countertop is adapted to be folded upon itself for storage.

5. The inflatable device according to claim 4, wherein each said at least one hinge has a center folding groove and a pair of side grooves, each said side groove dimensioned to receive and frictionally retain a panel therein.

6. The inflatable device according to claim 5, wherein the countertop panels are formed of a hard material selected from the group consisting of thick plastic, wood and metal.

7. The inflatable device according to claim 6, wherein each of the bar segments is formed as an elongate, airtight tube.

8. The inflatable device according to claim 7, wherein the bar segment tube is formed as a rectangle.

9. The inflatable device according to claim 8, wherein the support means comprises a plurality of interior walls traversing the bar segment tube to form a plurality of cells.

10. The inflatable device according to claim 9, wherein each interior wall has a hole therethrough for fluid communication between the cells.

11. The inflatable device according to claim 10, further comprising a layer of material for covering the countertop of the bar.

12. The inflatable device according to claim 11, wherein the bar segments comprise inside and outside walls;

an access door;

means for removably securing the access door to an inside wall and a complementary portion of an opposed outside wall of a bar segment enabling entry and exit from behind the bar.

13. The inflatable device according to claim 12, wherein the means for removably securing is a zipper.

14. The inflatable device according to claim 13, further comprising at least one reclosable pouch adapted to be removable secured upon the inside wall of a bar segment.

15. The inflatable device according to claim 14, further comprising at least one poster display pouch, each said at least one display pouch having front and back portions, each said front portion comprising a transparent material and the back portion of said at least one display pouch adapted to be removably affixed to the columns of the roof tubes.

* * * * *